US008047521B1

(12) United States Patent
Volkert

(10) Patent No.: US 8,047,521 B1
(45) Date of Patent: Nov. 1, 2011

(54) MAKING MAGAZINE POP-UP FORMATS

(76) Inventor: John K. Volkert, Glenview, IL (US)

( * ) Notice: Subject to any disclaimer, the term of this patent is extended or adjusted under 35 U.S.C. 154(b) by 0 days.

(21) Appl. No.: 13/017,987

(22) Filed: Jan. 31, 2011

Related U.S. Application Data

(62) Division of application No. 12/129,362, filed on May 29, 2008, now Pat. No. 7,878,494.

(60) Provisional application No. 60/940,419, filed on May 29, 2007.

(51) Int. Cl.
*B41F 13/56* (2006.01)
*B41F 13/54* (2006.01)

(52) U.S. Cl. ..... 270/21.1; 270/4; 270/5.02; 270/8; 270/9; 270/17; 270/20.1; 270/45; 270/51; 270/52.07; 270/52.17; 270/52.18

(58) Field of Classification Search ..... 270/4, 5.02, 270/5.03, 8, 9, 17, 20.1, 21.1, 45, 51, 52.07, 270/52.09, 52.17, 52.18; 156/250, 256; 40/124.08
See application file for complete search history.

(56) References Cited

U.S. PATENT DOCUMENTS

| | | | |
|---|---|---|---|
| 3,995,388 | A | 12/1976 | Penick et al. |
| 4,212,231 | A | 7/1980 | Penick et al. |
| 4,337,589 | A | 7/1982 | Volkert et al. |
| 4,349,973 | A | 9/1982 | Penick et al. |
| 4,408,755 | A | 10/1983 | Meier |
| 4,842,303 | A | 6/1989 | Molenda |
| 4,867,480 | A | 9/1989 | Volkert |
| 5,582,888 | A | 12/1996 | Volkert |
| 5,918,908 | A | 7/1999 | Barnett et al. |
| 6,764,569 | B1 | 7/2004 | Becher et al. |
| 6,858,285 | B1 | 2/2005 | Hamilton et al. |
| 6,953,513 | B1 | 10/2005 | Volkert |

*Primary Examiner* — Leslie A Nicholson, III
(74) *Attorney, Agent, or Firm* — Fitch Even Tabin & Flannery

(57) ABSTRACT

A method of making magazine formats in the form of signatures that include a flat 3-D piece that is die-cut from a web on a web press, which produces a plurality of such identical signatures as part of a high speed operation. The flat 3-D piece is located at the upper edge of one sheet and is freed from the remainder of the page on which it is die-cut when the lateral edges of the folded signature are trimmed.

19 Claims, 15 Drawing Sheets

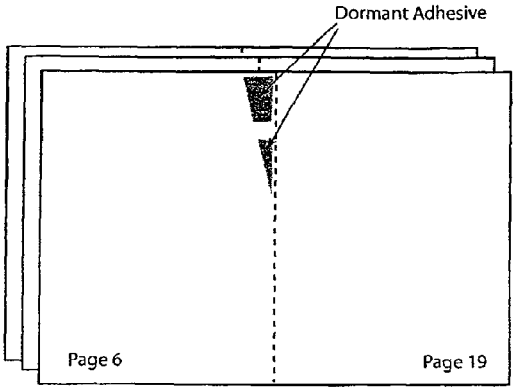
Fig. 21A Folio B
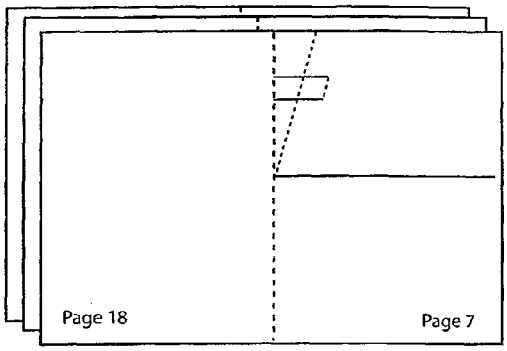
Fig. 21B Folio A
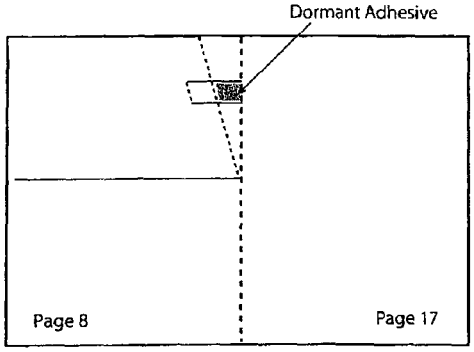
Fig. 21C Folio A (Back of Pages 7 & 18)
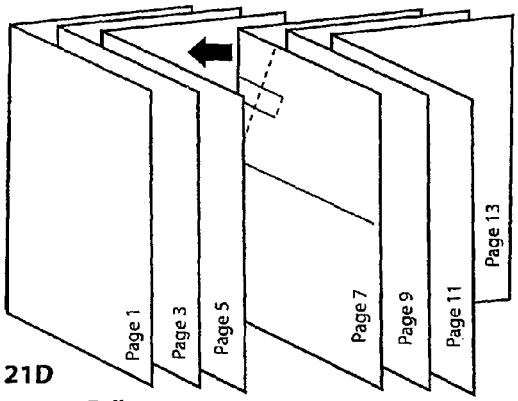
Fig. 21D Folio B Folio A
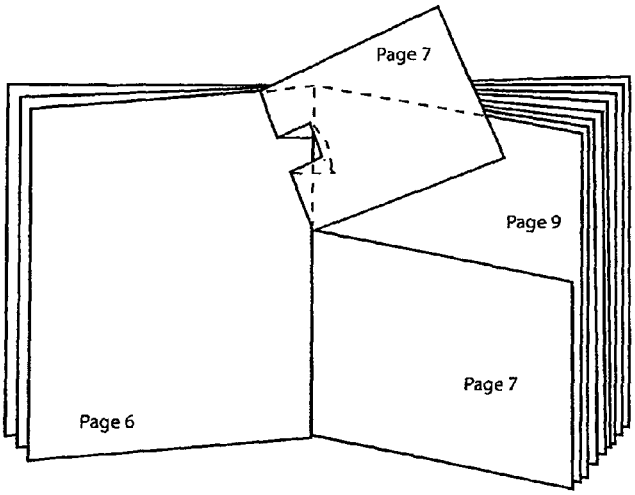
Fig. 21E Adhesive Applied Here
Adhesive
Pg 8
Pg 9
Pg 6
Pg 11
Pg 2
Pg 3
Pg 7
FOLD
Kiss Cut
Kiss Cut Die Mount
Page 7
Page 6
Page 11
Page 10
Page 2
Page 5
Page 4
Page 3
Page 1
FOLD
Pages 2 & 3
Page 12
Page 11
Page 10
Page 7
Page 6
Page 5
Page 4
Page 1
Pages 8 & 9
Fig 26 - Top View
NOTE: Page width of 10-9 & 8-7 shorten for clarity
Page 5
Page 1
Page 7
Page 9
Page 6
Page 11
Page 2
Page 3
Spine
Kiss Cut Die
Kiss Cut Die Roller
Page 5
Adhesive Application
FOLD
Page 6
Page 7
Page 4
Page 9
Page 2
Page 11
Page 5

Continued from Fig 28B
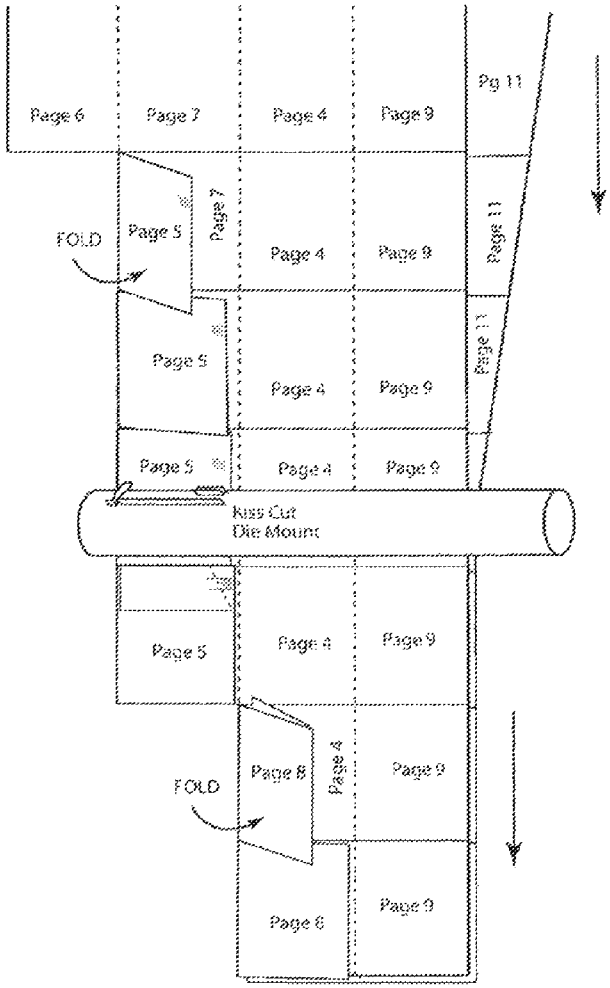
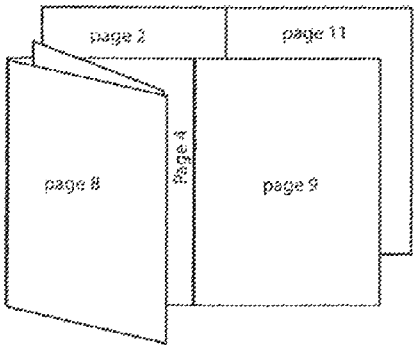
Fig 29
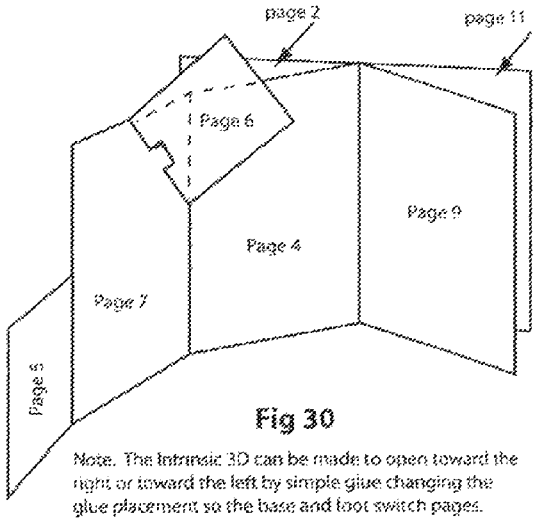
Fig 30
Note. The Intrinsic 3D can be made to open toward the right or toward the left by simple glue changing the glue placement so the base and foot switch pages.

MAKING MAGAZINE POP-UP FORMATS

This application is a divisional of U.S. Ser. No. 12/129,362, now U.S. Pat. No. 7,878,494, which claims priority from U.S. provisional application Ser. No. 60/940,419 filed May 29, 2007, the disclosures of both of which are incorporated herein by reference.

There is an existing desire to be able to present 3-dimensional print paper products in such as publications, magazines, newspapers, catalogs, books and the like, which continues to exist with significant demand. Presented here is a product that is made using a new method that renders such a product commercially feasible. It improves the versatility for the 3D products, providing significant cost effectiveness and extended design options and enabling greatly expanded uses that are not currently feasible in matching design and cost.

The ability for conventional pages and 3D dimensional pages to be printed collectively, as components of the same signature pages, should guarantee substantial market volume. They may be produced from a blank roll and printed and folded collectively to become the same 3D Signature formed in one pass on a web press.

Web presses have printed pop-up elements, and continue to do so. But pop-up elements are printed exclusively alone without any publication pagination. Today, even though an existing pop-up format can be printed and glued on a web press, it cannot be bound to pages of magazines etc. in the same operation. A separate binding operation adjustment must be undertaken to add a "hanger" or "backbone strip", enabling the current pop-up format to be bound separately. The dimensional pop-up structure elements are then within the centerfold page of the structure. With a pop-up element affixed to the center-spread, the signature cannot be later combined with other signatures having the centerfold straddling a binding machine conveyer chain. Therefore, such are not currently printed simultaneously with other pages of a magazine, brochure, book or the like.

The use of paper in our society is very significant: magazines, newspapers, books, mailers, cards, instruction sheets and computer printouts are important ways of communicating information to many markets. Publishers strive for public interest, and regardless of whether a paper product is mailed, hand delivered or purchased, it is generally being used in volume to creatively communicate and draw attention. There are daily, weekly and monthly publications, and there are many advertisers within each, vying for the readers' attention. Their efforts may include black & white printing along with color printing, in different sizes on low folio and high folio pages, quarter, half and full pages along with 2 page spreads; all these exist as flat pages bound or collected together in a signature.

The cost efficiencies of the 3D format presented here are such that it can be printed with variable pagination. Versatile placement can be provided as it is bound contiguously with the pages of the publication where it becomes a component of the publication. It is adaptable to various binding methods.

Persons, seriously or casually, reading a publication will stop upon turning to the page that will move a 3D format sheet into 3-dimension. It has been verified that the average reader will likely close and reopen the page more than once. This is why an advertiser will be very interested in selecting such a 3D pop-up format; the advertiser's ad will have attention drawn to it in a way that is truly cost-effective. Although this format has a significant advantage by "Standing Up" in its 3D shape, yet it has simplicity and is effective, versatile and less costly than other dimensional paper products.

A method of making dimensional inserts in publications and the like has been developed that is different than anything of its kind in the last forty years. It is a method that has great versatility in creating and developing products of this type.

Pages in magazines, books, brochures and the like are generally made up of folded pages joined together in saddle form as the backbone of one folded signature straddles over another, i.e. in saddle-stitch binding. Stacking one folded signature upon another is another assembly method, i.e. in perfect bound binding. These signature assembly methods, e.g. Saddle Stitched, Side Stitched and Perfect Bound, describe the currently predominant binding styles of assembling folded signatures into booklet formats, such as magazines.

To date, current magazines, books, brochures and like folded items have been used as carriers for a supplemental piece that may include a three dimension pop-up item. The pop-up item is separately manufactured and is designed to be glued onto separately printed pages as a supplement, as illustrated in U.S. Pat. No. 6,953,513.

SUMMARY OF THE INVENTION

This new method enables 3D pieces to be printed together with pages of the magazines as part of the signature. One or more such 3D pieces can be printed collectively with the accompanying magazine pages for one signature. Whereas the more cost-effective means of printing is web press printing, the method might be also practiced as a part of sheet feed printing.

In one particular aspect, the invention provides a method of making magazine formats that include a pop-up structure wherein a 3D piece is operatively created from one printed page, which method comprises printing a plurality of signatures on a web fed press, which signatures each include at least two pairs of consecutively numbered or designated pages which are designed for assembly to create a magazine, conveying said pages along a path during the assembly of one signature for the magazine format, die-cutting a flat 3D piece in one of said pages at a location along said path, placing adhesive on surfaces of said web at locations which will create an adhesive bond to front and rear surfaces of said die-cut 3D piece, and completing assembly of the magazine format by collecting said signature and associating it with other signatures for binding, whereby said die-cut 3D piece becomes adhesively attached between two facing pages in said signature so that, when a recipient of the magazine opens the magazine format to the page which was die-cut to create said 3D piece, said 3D piece pops-up and assumes an attention-attracting three-dimensional configuration.

In another particular aspect, the invention provides a method of making magazines that include a pop-up structure wherein a 3D piece is operatively created as a part of one printed page, which method comprises printing a plurality of first signatures on a web fed press, which first signatures each include at least three pairs of consecutively numbered or designated pages which are designed for assembly to create a magazine and which include a front page, a central page and a rear page, conveying said pages along a path as a part of the assembly of a first signature, placing adhesive on a surface of said web at a location which will create an adhesive bond between said central page and either said front or rear page of said signature, kiss-cutting a flat 3D piece from said central page while it is in surface to surface contact with either said front or rear page with said adhesive sandwiched therebetween, placing adhesive on another surface of said web at a location where it will create a bond between the opposite surface of said central page in the region of said 3D piece and said facing surface of the other of either said front or rear page, placing said last mentioned page in association with central page as a part of said first signature, and completing the assembly of said magazine by collecting said first signature and associating it with other signatures for binding, whereby said kiss-cut 3D piece becomes adhesively attached between two facing front and rear pages and when a recipient of the magazine opens same to said kiss-cut central page, said 3D piece pops-up and assumes an attention-attracting three-dimensional configuration in direct association with said facing front page.

In a further particular aspect, the invention provides a method of making magazines which include a pop-up structure wherein a 3D piece is operatively created as a part of one printed page, which method comprises printing a plurality of signatures on a web fed press, which signatures each include a group of at least three sheets which carry side-by-side pairs of printed pages that are designed for assembly to create a magazine, said group including a front sheet, a central sheet and a rear sheet, conveying said sheets along a path as a part of the assembly of a first signature and applying adhesive to at least one page of one of said sheets, superimposing said central sheet and either said front or said rear sheet with said adhesive sandwiched therebetween, kiss-cutting a flat 3D piece from one page of said central sheet while it is in surface to surface contact with either said front or rear page, placing adhesive on another surface of said web at a location where it will create a bond between the opposite surface of said central sheet page and said facing page of either said front or rear sheet in the region where said kiss-cut 3D piece is located, associating said last mentioned sheet in surface contact with said central sheet as a part of said first signature, and completing the assembly of said magazine by collecting said first signature and associating it with other signatures for binding, whereby said kiss-cut 3D piece becomes adhesively attached between two facing pages and when a recipient of the magazine opens same to the kiss-cut page of said central sheet, said 3D piece pops-up and assumes an attention-attracting three-dimensional configuration in direct association with said facing pages.

In yet another particular aspect, the invention provides a signature format which includes a pop-up structure for inclusion in the assembly of a magazine, which signature format comprises a group of at least three sheets which carry side-by-side pairs of printed pages that are designed for assembly as a signature or part of a signature to create a magazine, said group including a front sheet, a central sheet and a rear sheet, a flat 3D piece die-cut within one page of said central sheet, and adhesive in place between said 3D piece that is an integral part of said central sheet and the facing pages of said front sheet and said rear sheet, said adhesive being sandwiched between one respective surface of said 3D piece portion of said central sheet page and the respective facing pages and creating a bond thereto, and whereby after a magazine is assembled by collecting said signature format and associating it with other signatures for binding, and when a recipient of the magazine opens same to the die-cut page of said central sheet, said 3D piece assumes an attention-attracting three-dimensional configuration in direct association with said facing pages.

In still another particular aspect, the invention provides a method of making a signature for incorporation in a magazine, which signature includes a pop-up structure wherein a 3D piece is cut from one printed page, which method comprises printing a plurality of signatures on a web fed press, each of which signatures includes a group of at least four page panels across the width of the continuous web that are designed for assembly as one signature in a magazine, said group including two hinged base page panels and two hinged fold-out page panels, conveying said at least four panels along a path as the continuous web, applying adhesive patterns to two page panels of said signature, superimposing one of said fold-out page panels upon the other with one said adhesive pattern sandwiched therebetween, kiss-cutting a flat 3D piece from said one fold-out page panel while it is in surface to surface contact with said other fold-out page panel, folding said fold-out panels so they are superimposed upon the one base page panel to which they are hinged so that the other adhesive pattern will create a bond between the opposite surface of said flat 3D piece and said one base page panel, folding said web to sandwich said fold-out panels between said hinged base page panels, severing said signature from the continuous web, and completing the assembly of said magazine by collecting said signature and associating it with other signatures for binding, whereby said kiss-cut piece becomes adhesively attached between two facing page panels that are hinged to each other so that when a recipient of the magazine unfolds said fold-out page panel from said hinged base page panel and opens same folded fold-out page panels, said 3D piece pops-up and assumes an attention-attracting three-dimensional configuration.

In one still more particular aspect, the invention provides a signature format which includes a pop-up structure for inclusion as part of the assembly of a magazine, said signature format comprising a group of at least four side-by-side printed page panels designed for assembly as a signature or part of a signature to create a magazine, said group including two hinged base page panels and two hinged fold-out page panels, with a flat 3D piece die-cut from the end fold-out page panel, and said fold-out page panels being folded on each other and sandwiched between said folded hinged base panels with adhesive bonds between portions of said 3D piece and the facing page panels of said other fold-out page panel and said hinged base page panel, whereby after a magazine is assembled by collecting said signature format and associating it side-by-side with other signatures for binding, when a recipient of the magazine opens same to the facing base page panels and unfolds said fold-out page panels, said 3D piece assumes an attention-attracting three-dimensional configuration.

BRIEF DESCRIPTION OF THE DRAWINGS

FIGS. 21A and 21B further exemplify a product similar to that which results from FIG. 20B.

FIG. 21C shows the top sheet of FIG. 21B from the rear surface.

FIG. 21D is a view similar to FIG. 20B showing the signatures of FIGS. 21A and 21B being assembled.

FIG. 21E is a view similar to FIG. 20C.

FIG. 23 shows yet another web press operation embodying various features of the invention.

FIG. 24 is a view similar to FIG. 1A of the device used in FIG. 23.

FIGS. 25 and 26 are schematic views showing the folded arrangement of the product that results from the web press operation of FIG. 23.

FIG. 27 is a perspective view showing the product from FIG. 23 opened to the configuration in which it would appear in a magazine that is opened to the two pages marked 2 and 11 for identification in FIG. 27.

FIG. 28B shows the continuation of FIG. 28A.

FIG. 29 is an exploded schematic showing the resultant product from the web press operation of FIGS. 28A and 28B.

FIG. 30 is a perspective view showing the signature of FIG. 29 open to pages 4 and 9.

DETAILED DESCRIPTION OF THE PREFERRED EMBODIMENTS

Figures 1, 1A, 2, 3:
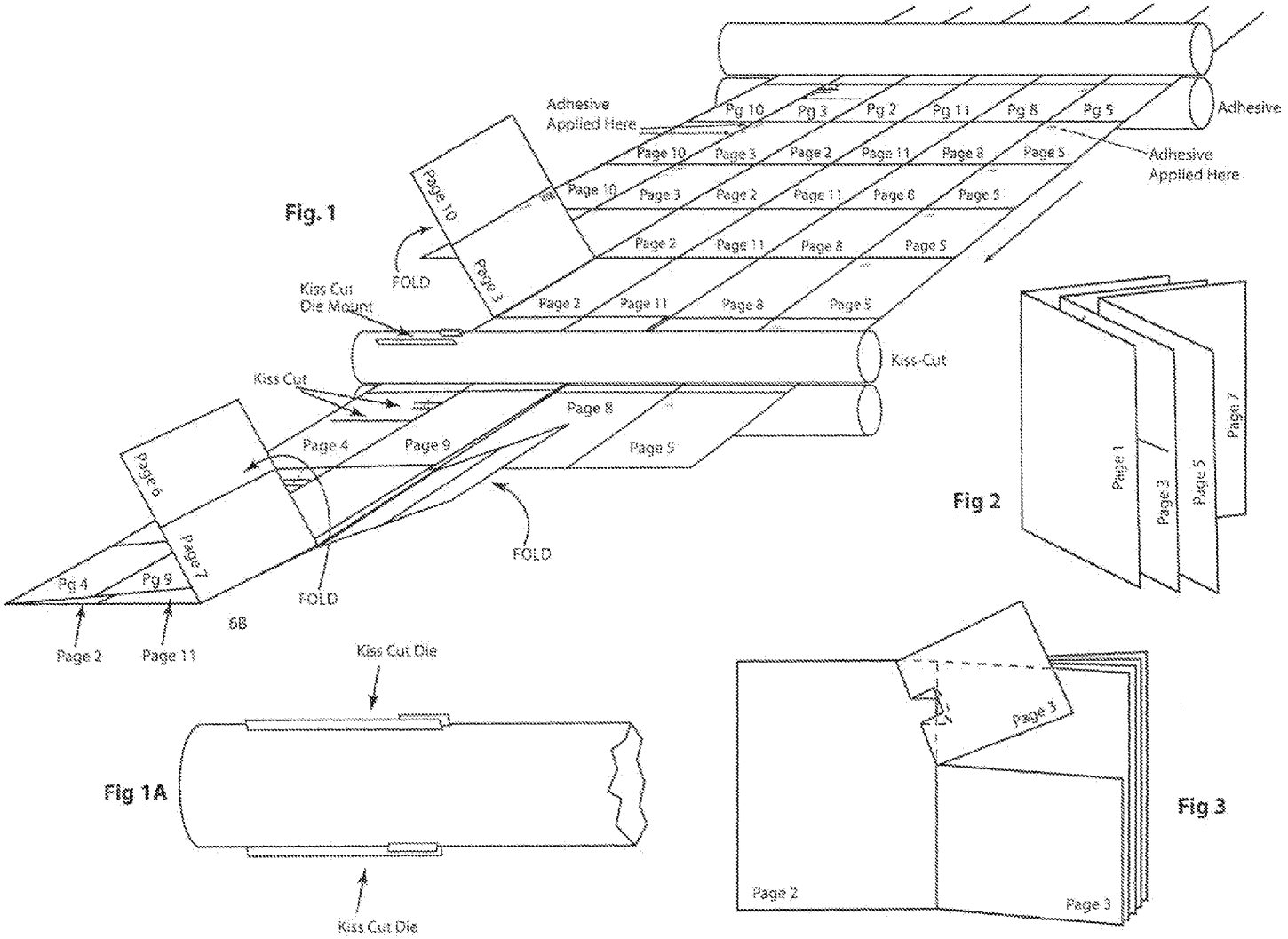
FIG. 1 shows a web press operation embodying various features of the present invention.
FIG. 1A is an enlarged fragmentary view showing the kiss-cut die rotary device of FIG. 1.
FIG. 2 is an exploded perspective view showing the arrangement of the folded sheets in the final product.
FIG. 3 is a perspective view showing the final product opened to pages 2 and 3.
Figure 4A:
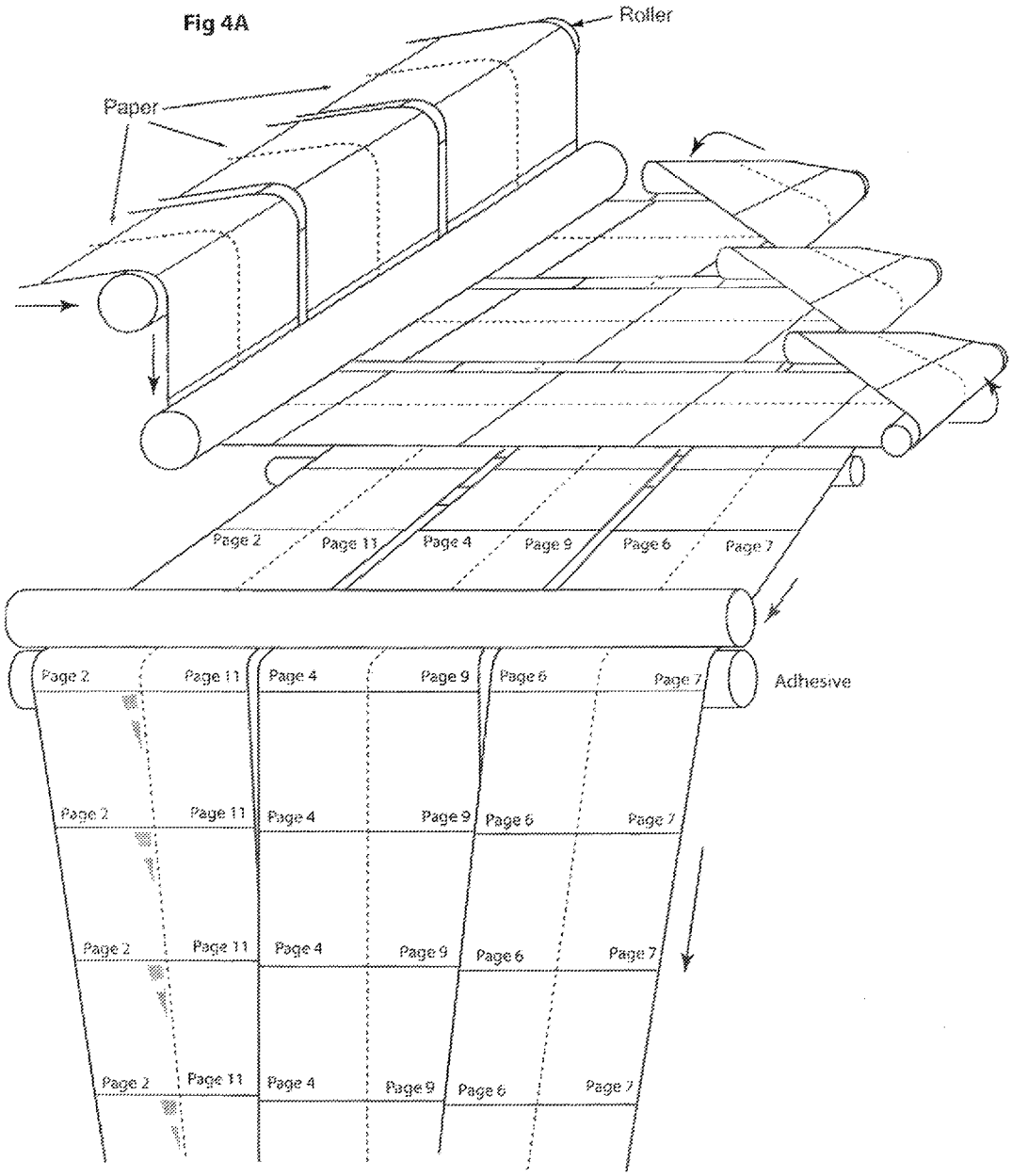
FIG. 4A illustrates a web press operation showing another production method embodying various features of the present invention.

FIG. 1 shows a web fed press that is printing sheet material that has three panels abreast, each of which panels is sized to provide two side-by-side pages (each of which will be printed front and back); the pages are labeled with consecutive page numbers according to their alignment in the final signature. By suitable manipulation of the continuous web, the web fed press is employed to kiss-cut a single sheet 3D piece from at least one of the inner panels by a suitable mechanism and produce a signature composite which is then severed from the leading end of the web. One, two or more such composites at a time can be incorporated into a perfect-bound magazine or a saddle-stitched magazine together with other signatures. Alternatively, this type of arrangement, or the embodiment shown in FIGS. 4A and 4B, may be used to produce a folded magazine similar to the well known Sunday supplement Parade magazine. Such might be accomplished, for example, simply by associating other panels with three panels that are depicted. The group of three, when folded along the centerline, produce a 12-page signature. Such a 12-page signature is shown schematically in FIG. 2 in exploded perspective just for purposes of illustration. FIG. 3 is a better illustration which shows the three panels having a common fold line, and the 3D piece that was cut during the production from an integral portion of a page, from the center panel of the three panels, in their ultimate orientation. By coating one panel with adhesive prior to kiss-cutting the 3D piece from the center panel, one surface of the 3D piece will already be securely attached to one facing page when the kiss-cutting is completed. Likewise, similar application of adhesive (either before or after kiss-cutting) either to an appropriate region of the opposite surface of the 3D piece, or to the corresponding region of the panel that will be brought into contact with it, will complete the pop-up structure, wherein the kiss-cut, single-sheet, 3D piece, integral portion of an interior page is now adhesively attached to both facing pages as shown in FIG. 3.

A high speed web press generally operates at very high linear speeds, compared to the standard binding line types of conveyances; yet, such can still be equipped with adhesive applicators and rotary kiss-cutting mechanisms (FIG. 1A) for fashioning a 3D piece directly from the moving continuous web. This greatly simplifies the alternative operation of applying a separately formed pop-up piece onto a high speed web press. Kiss-cutting or die-cutting a 3D piece upon a web press effects sizable cost reduction and allows more options of use when advertising budgets are a prime consideration.

Diagrammatically depicted in FIG. 1 is one such high speed production method. More specifically, procedures along the high speed line are shown so far as the second folding step toward creating the final signatures. As well known in production, and as shown in the aforementioned '513 patent, the disclosure of which is incorporated herein by reference, the two side edges would be trimmed, either before or after being folded in half along the center line. The composite signature, including the 3D piece that is integrally connected to a portion of the panel from which it was kiss-cut, would be severed transversely from the leading end of the high speed web. At a later station, this signature might be associated with, e.g. covered by, another folded 12-page signature. In turn, additional signatures (not shown) could be placed thereatop or gathered therewith as a part of the collation process preliminary to a final perfect binding step.

The resultant 12-page composite signature is shown in FIG. 3 where it has been opened so that pages 2 and 3 of the signature composite are spread apart, causing the adhesively attached 3D piece that was kiss-cut from page 3/4 to assume an attractive three-dimensional configuration. If desired, two 3D pieces could be kiss-cut from the same panel (shown hereinafter) or from a different page of an inner panel within the signature composite, e.g. page 9/10.

The foregoing methods employ known machinery used in this art. It will of course be understood by those skilled in this art that various of the methods illustrated and described herein can be combined with one another to create a desired product in a particular production method.

The process is cost effective when die-cutting (or kiss-cutting, which is a form of die-cutting that only cuts the uppermost sheet) and enables high speed production, as shown. Shown in the embodiment depicted in FIG. 1 kiss-cut die-cutting uses the rotating cutter shown in FIG. 1A. Such enables a press to run faster than if multiple thicknesses of paper were being die-cut at one such cutting station. FIG. 1 shows a full web width that has been printed to provide three side-by-side, double-page panels; as labeled on the drawing, they would constitute, respectively from left to right, pages 10, 3, 2, 8, 11 and 5. The printed web passes under an adhesive application station where there are two patterns of adhesive applied. One is to the upper left hand corner of page 3, the other is to the upper left hand corner of page 5. As the web progresses, the left hand one third of the width of the web, i.e. the panel comprising pages 10 and 3 on its upper surface, is plowed over onto the middle panel, the upper surface of which constitutes pages 2 and 8. Although the panels are shown schematically in FIG. 1 as being transversely severed at this point for ease of illustration, the web would remain integral, i.e. there would be no division of the elevated panels shown from the preceding and following panels; such is simply illustrated in the present manner simply for clarity of explanation.

After the left hand panel has been folded onto the middle panel, pages 2 and 3 are juxtaposed and their associated pages 10 and 11 also are juxtaposed. With the folding of the left hand one-third of the web complete, the web passes under the rotary kiss-cut mechanism where the rotary kiss-cut die cuts the trailing one-half of the page that will form page 3/4 in the signature; it creates a 3D piece which is an integral portion of the page by providing two parallel short cut lines that extend to the centerline of the 2-page panel and one long cut line that extends from the centerline and across the page but terminates just short of the opposite edge. If desired, the mechanism also simultaneously creates one or more lines of weakness on page 3/4 that is presently atop page 1/2 on the fast moving web, in the vicinity of the two short parallel cut lines which form a hinge arm. Next, the right hand one-third of the web is plowed onto the upper surface of the previously plowed panel. As a result, the adhesive pattern earlier applied to the upper left hand corner of page 5 now comes in contact with page 4 and creates an adhesive bond to a portion of the opposite surface of the 3D kiss-cut piece. The now three ply web would pass through appropriate compression rollers and then be likely folded once more along its center line and then edge-trimmed to eliminate the two edges along which folding occurred. This trimming frees the lower edge along the 3D piece which is now separated completely from the remainder of page 3/4, while leaving it integrally a part of the signature as a result of its joinder with page 9/10 along its fold line. The cut lines and/or lines of weakness that are achieved via the kiss-cutting are shown in greater detail in drawings of different composite signatures described hereinafter, e.g. FIG. 11. However, the FIG. 3 depiction on sheet 1 of the drawings is helpful to see the resultant composite signature product.

Because web presses in many instances require a travel path of substantial length to accomplish printing, severing and collection along with associated treatment stations, it is often useful to utilize 90° turns of the high speed web. Such an arrangement is depicted on sheet 2 of the drawings in FIG. 4A where the full width web depicted in FIG. 1 has been slit into three parallel ribbon webs of equal width following printing, which are then sent through a 90° turn station. In their new alignment, the ribbon webs are aligned with respect to the 12-page signature being created. The upper surface of the left hand ribbon panels constitutes pages 2 and 11. The upper surface of the middle ribbon panels constitutes pages 4 and 9. The upper surface of the right hand ribbon panels would constitute pages 6 and 7. After passage through the adhesive applicator which deposits an adhesive pattern on page 2, the web ribbons continue to move forward and begin to align one over the other.

Figure 4B:
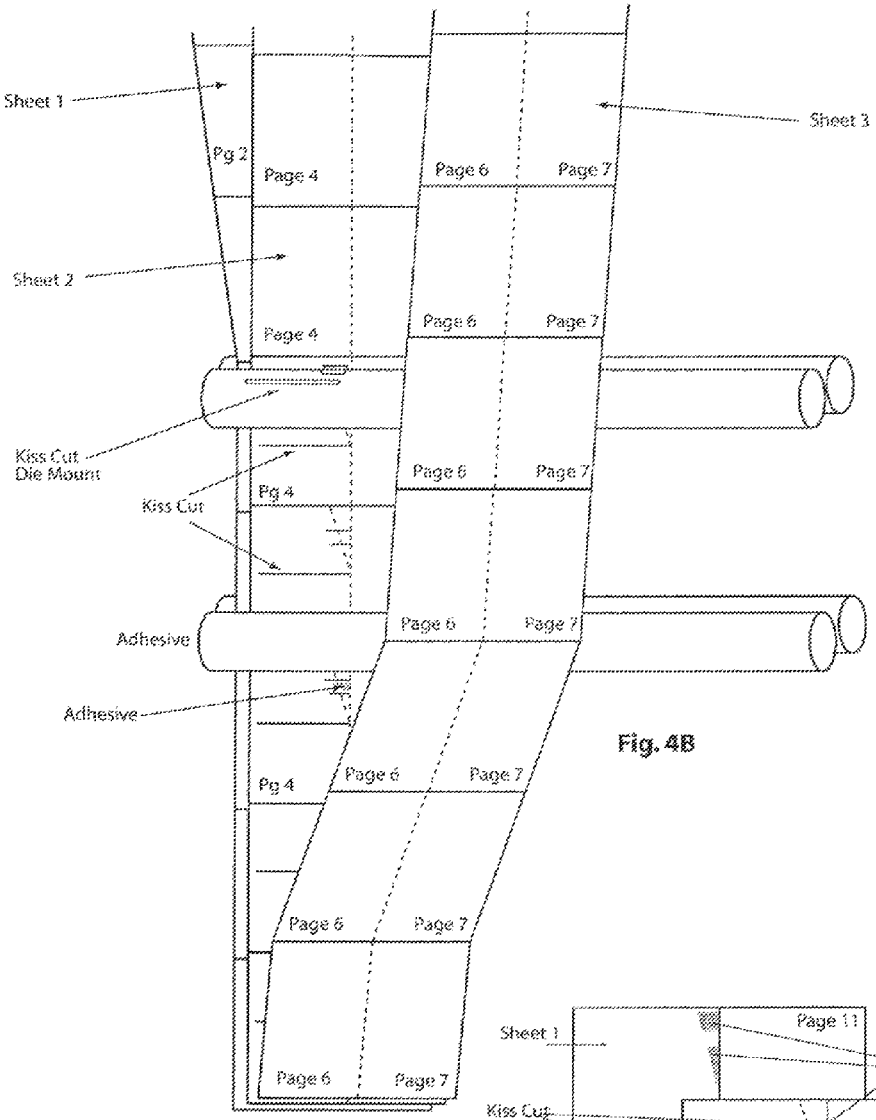
FIG. 4B is the continuation of FIG. 4A.
Figure 5:
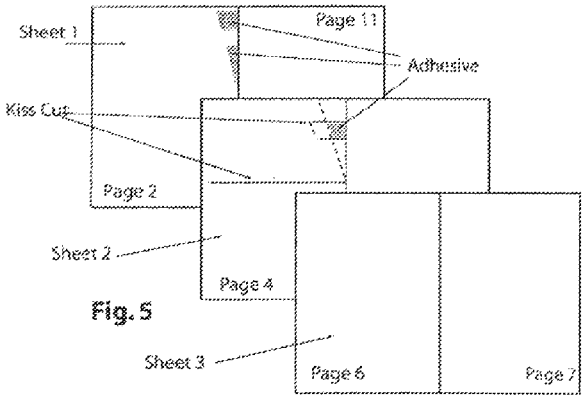
FIG. 5 is a schematic view illustrating the three pages that result from the production method of FIGS. 4A and 4B, shown in exploded perspective.

As seen in FIG. 4B (which is the continuation of FIG. 4A), the left hand and middle ribbons align and pass through the rotating kiss-cut die mechanism, whereas the right hand ribbon passes over this rotary mechanism and over a subsequent adhesive applicator. In the kiss-cut mechanism, the 3D piece is created by as before by kiss-cutting page 3/4 as it is traveling along atop page 1/2. Next, the adhesive applicator applies an adhesive spot to page 4 on a tab section of a hinge arm of the 3D piece, as illustrated in more detail in accompanying FIG. 5 which constitutes an exploded perspective of single panels from the three web ribbons. Following adhesive application, the right hand web ribbon is superimposed upon the underlying two ribbons, and the 12-page signature moves to completion where the side edges are trimmed. This releases the edge of the 3D piece from the remainder of page 3/4 while the piece is situated centrally sandwiched between upper and lower pages 1/2 and 5/6 to surfaces of which the 3D piece is adhesively connected.

Figure 6:
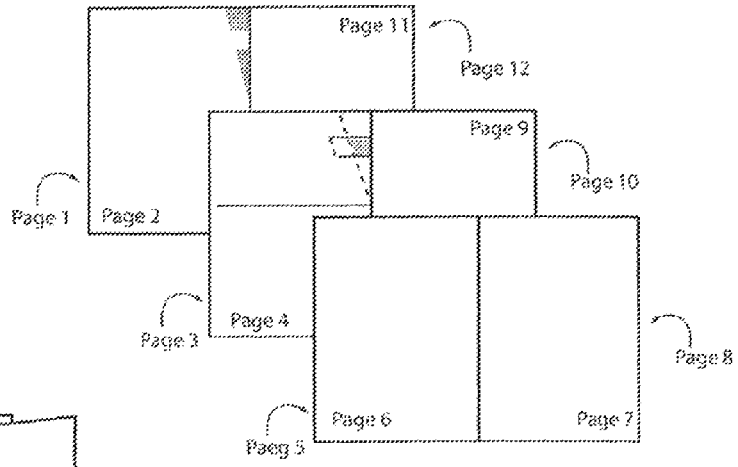
FIG. 6 is a view similar to FIG. 5 taken from the opposite side.
Figure 7:
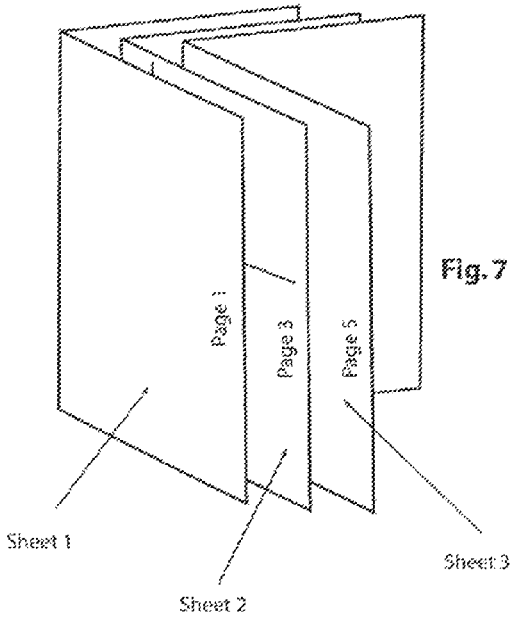
FIG. 7 is a view similar to FIG. 2 showing the product of FIGS. 4A and 4B.
Figure 8:
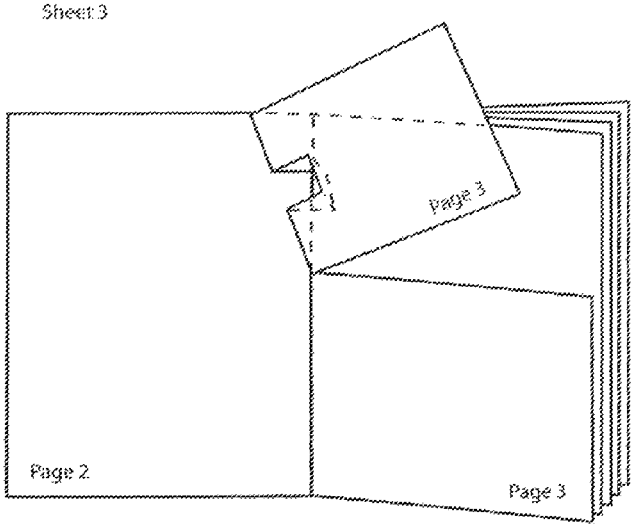
FIG. 8 is a perspective view of the final product from FIGS. 4A and 4B opened to pages 2 and 3.
Figure 9:
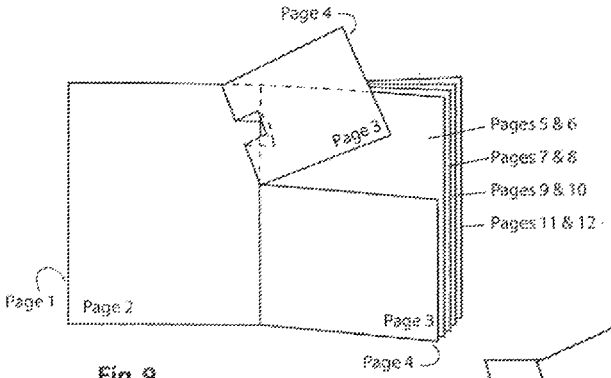
FIG. 9 is a view similar to FIG. 8 showing a similar product.
Figure 10:
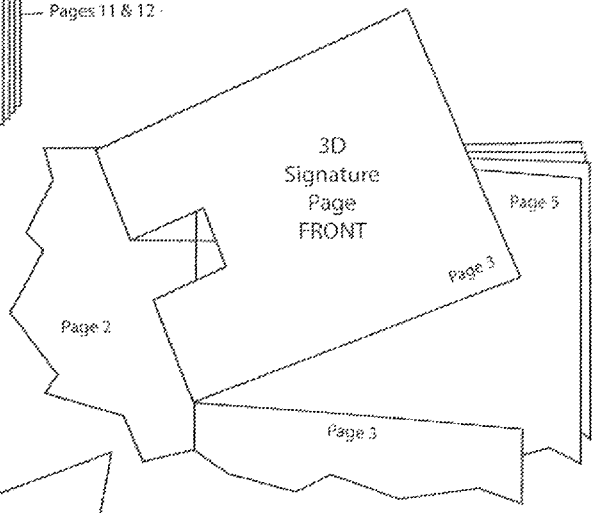
FIGS. 10 and 11 are fragmentary perspective views, enlarged in size, of the product shown in FIG. 9.
Figure 11:
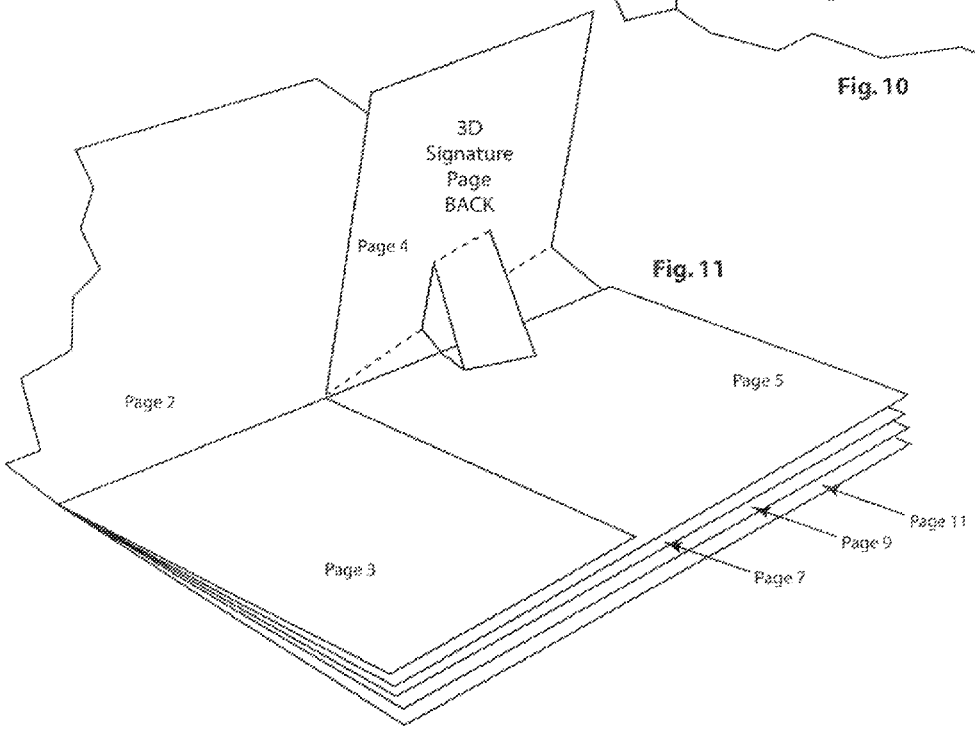

Shown in FIG. 6 on sheet 4 is an exploded version of the three panel stack wherein the numbers of the reverse page surfaces are indicated for possible clarification. FIGS. 7 and 8 are enlarged versions of FIGS. 2 and 3 wherein reference is made to the three folded panels as sheets 1, 2 and 3, as in FIG. 5. More views are shown in FIGS. 9-11. Thus, FIGS. 5-11 illustrate a 3D piece that is designed with angular lines of weakness and to be die-cut as an integral part of a magazine signature. The 3D piece is hinged at an angle to the fold line edge of the page so that it opens in an askew fashion. FIG. 11 shows the hinge arm of the 3D piece that has a tab adhesively affixed to page 5 that pulls the piece into its 3D configuration upon opening pivoting along the edge of a generally triangular base section of the 3D piece which is bonded to page 2. A line of weakness preferably defines the edges of the two-section base that is bonded to page 2; this line may be at an angle of about 10° to about 40° the spine of the signature.

Figure 12:
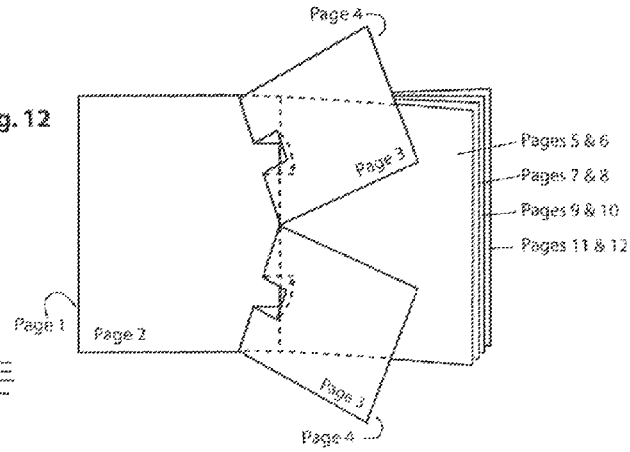
FIG. 12 is a view similar to FIG. 9 showing another product embodying various features of the invention.
Figure 13:
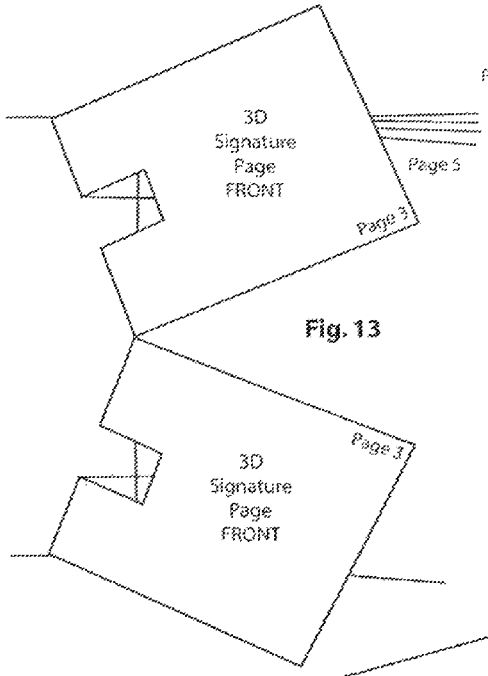
FIGS. 13 and 14 are fragmentary perspective views, enlarged in size, of the product shown in FIG. 12.
Figure 14:
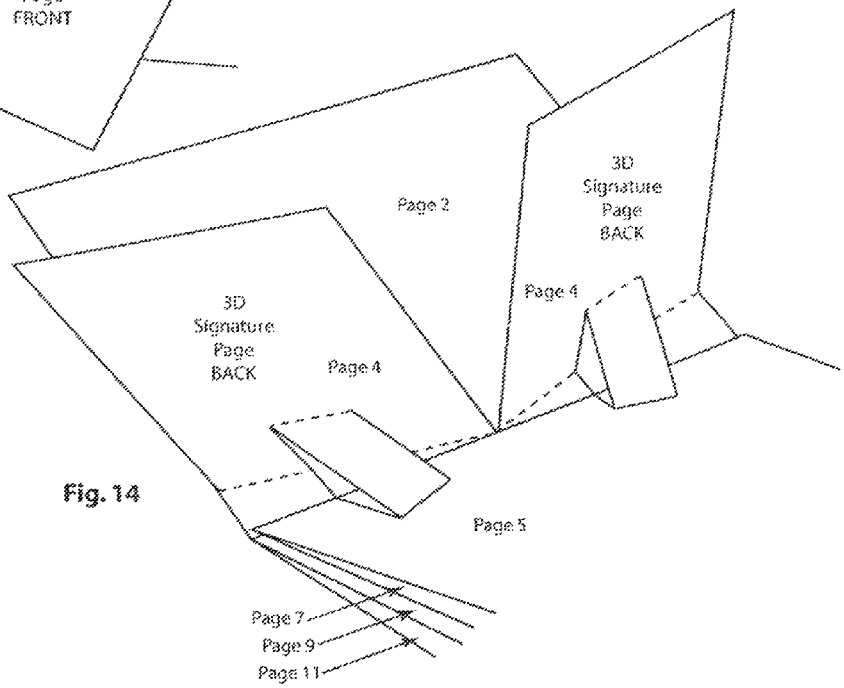

FIGS. 12, 13 and 14 illustrate a signature that could be similarly made where the kiss-cut mechanism is designed so as to die-cut two 3D pieces from the same page. The described sequence of steps could be similar. For example, instead of depositing adhesive patterns only in the upper left hand corners of pages 3 and 5 as shown on FIG. 1, such patterns would be placed in the upper left and lower left corners of both these pages. As a result of the double kiss-cutting, two 3D pieces are integrally formed from page 3/4 of the signature. As a result when the signature is opened and pages 2 and 5 are spread apart, both the upper and lower 3D pieces assume attention-attracting 3-dimensional orientations as seen in FIGS. 12, 13 and 14.

It can be seen from FIG. 1 that this method is capable of very high speed production for there is no danger of tension on the web tearing the web at the location of the transverse die-cuts that are used to form the integral 3D pieces, because the die-cutting occurs at a generally central location, spaced apart from any edge of the web; because the die-cuts are so well protected, web tension is not a matter of a concern. Generally similar is the arrangement depicted in FIGS. 4A and 4B where the web is slit into three ribbon webs. Two of the ribbons are superimposed before the kiss-cutting occurs, and the two webs are mutually supportive because of the adhesive attachment between facing surfaces of pages 2 and 3 of these two ribbons.

Figure 15:
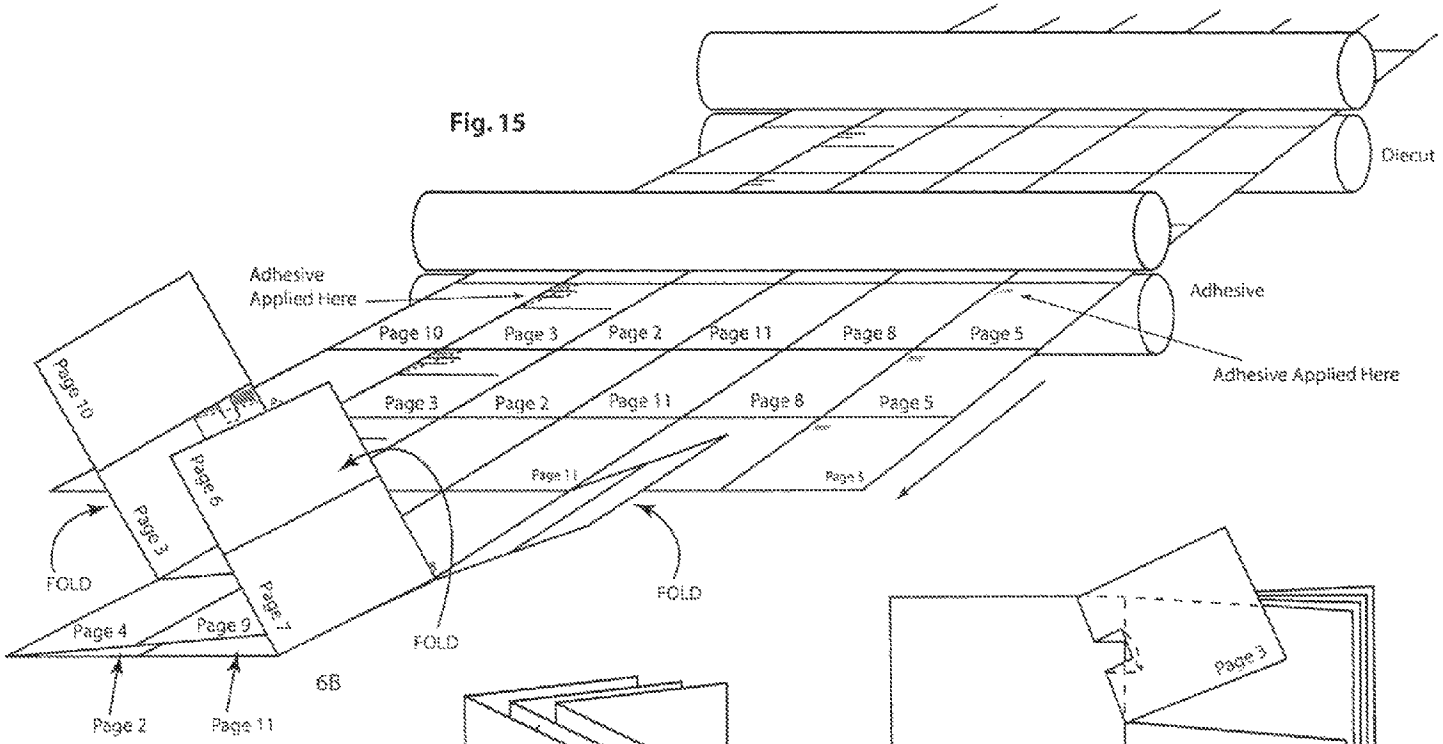
FIG. 15 shows another alternative web press operation embodying various features of the invention.
Figure 16:
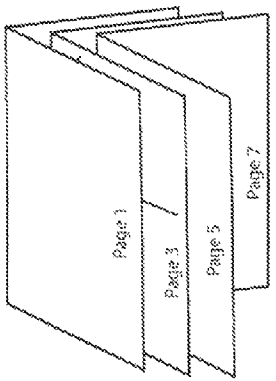
FIGS. 16 and 17 are views similar to FIGS. 2 and 3 of the product of FIG. 15.
Figure 17:
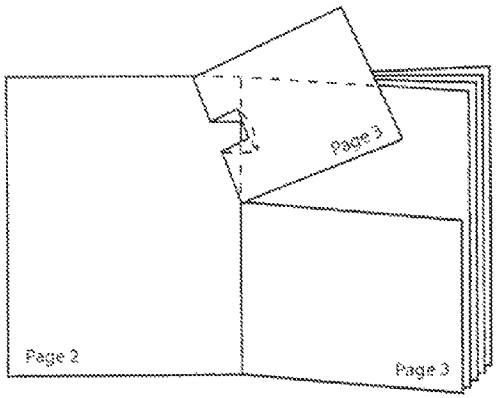

Although the kiss-cut arrangement for forming the one or more 3D integral pieces in the continuous web is preferred, standard die-cutting is also feasible; such is shown in FIG. 15 which shows a full width web, similar to that shown printed in FIG. 1. In FIG. 15, die-cutting of the 3D piece is carried out directly on the web before any folding of the web occurs. In this embodiment, the printed pages running across the web from left to right are pages 10, 3, 2, 11, 8 and 5. One particular sequence is illustrated, but it should be understood that different sequences might be used. The web is first die-cut at the rotary die-cut station to form the 3D piece in page 3/4, at a location generally centrally of the left hand panel. The web then passes through the adhesive application station, and two patterns or patches of adhesive are applied to the surface of page 3 in the region of the triangular base panel that is defined by the angular line of weakness discussed hereinbefore. At the same time, a small adhesive pattern is applied to the surface of the upper left hand corner of page 5 in the location where it will be eventually aligned with and will contact the tab at the end of the hinge arm of the 3D piece. While the adhesive remains tacky, the high speed web is moved through a plow section where the left one-third of the web, i.e. the panel comprising pages 3 and 10, is plowed or folded onto the upper surfaces of pages 2 and 11. This adhesively secures the base panel region of the 3D format piece to the surface of page 2. As this occurs, the right hand one-third of the web is being substantially simultaneously plowed over the top of the left-hand one-third. When these two panels are superimposed on the middle panel, the adhesive that was applied to the upper left hand corner of page 5 bonds this page 5 to the surface of page 4 in the region of the tab of the hinge arm. The remainder of the web operation, with regard to its trimming and severing into signatures, then proceeds as described hereinbefore with respect to FIG. 1. Comparison of FIGS. 16 and 17 to FIGS. 2 and 3 will show that the resultant composite signature from the method illustrated in FIG. 15 is indistinguishable from that produced by the method illustrated in FIG. 1.

Figure 18A:
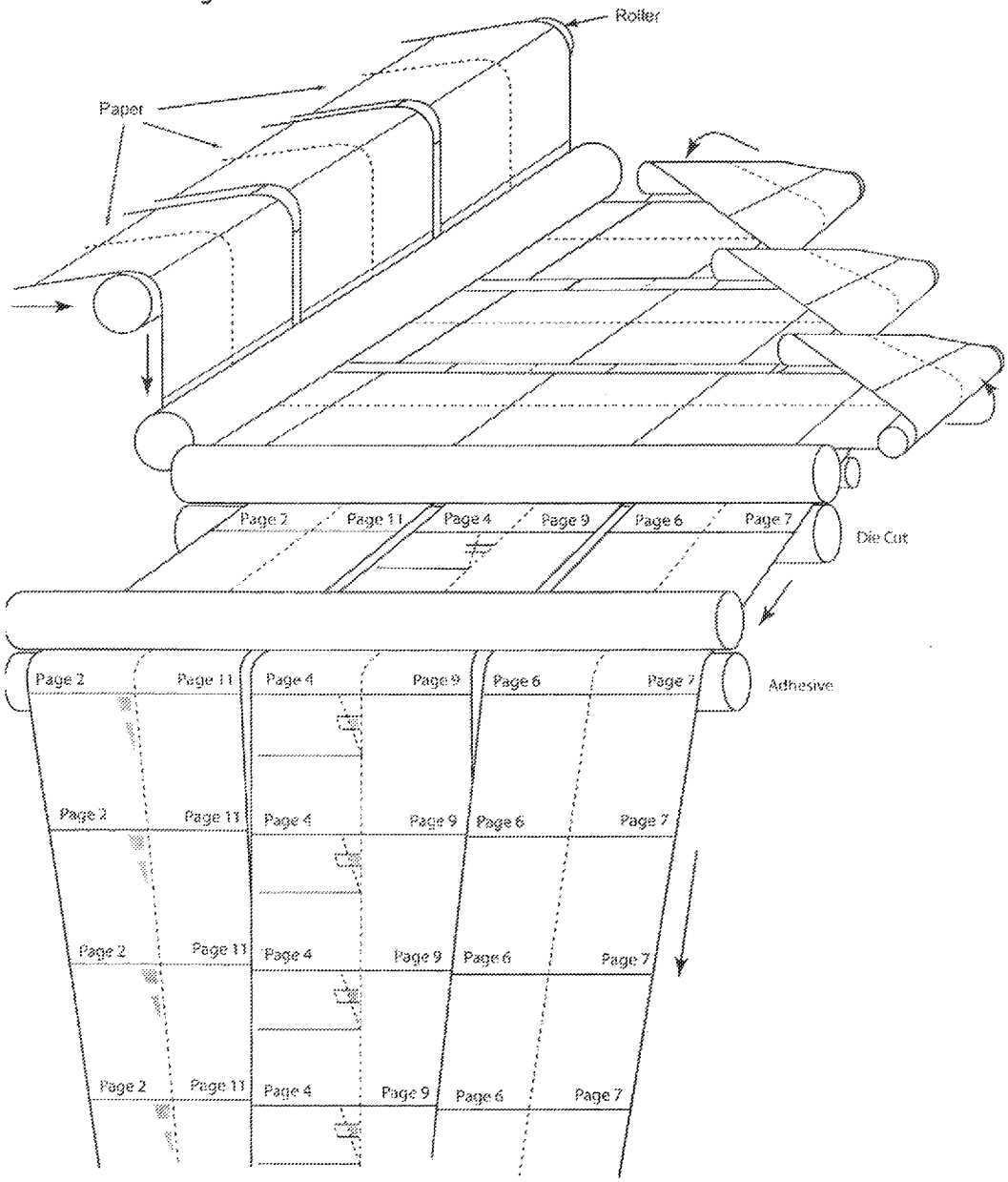
FIG. 18A is a view of the further alternative of a web press operation embodying various features of the invention.
Figure 18B:
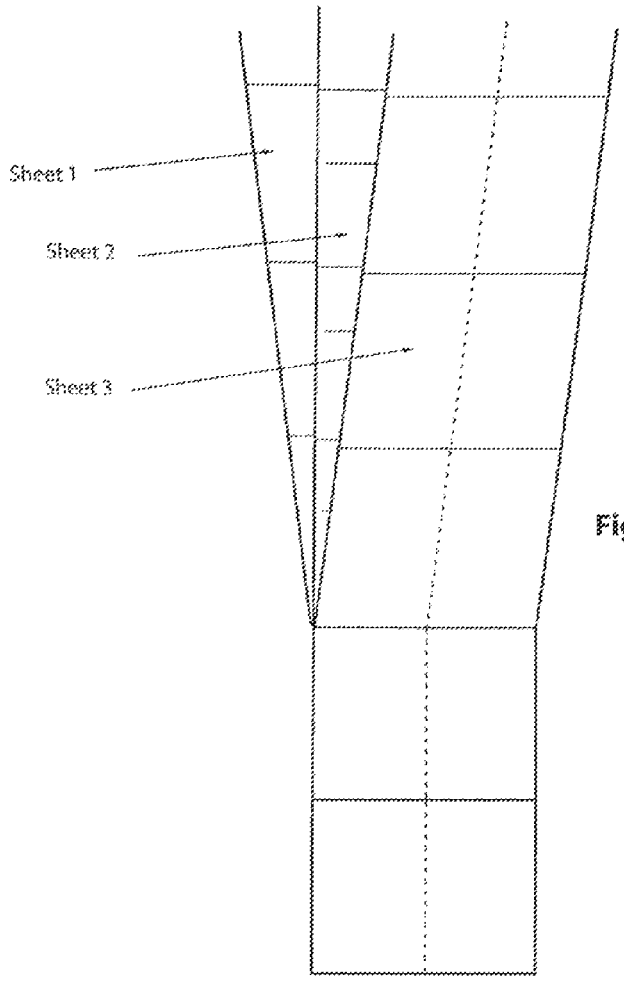
FIG. 18B is the continuation of FIG. 18A.

As shown in FIGS. 18A and 18B, such die-cutting of the single thickness web, as opposed to kiss-cutting, may also be executed in a printed web that has been slit into three or more ribbon webs that are running parallel to one another. As seen in FIG. 18A, the central ribbon is initially die-cut by the rotary die-cut mechanism to create a 3D piece in the trailing one-half portion of the left hand page, i.e. page 4, of the middle ribbon. The operation is carefully sized so that there is an ample trim region along the side edge of the central page that will space the end of the die-cut main slit from the edge of the ribbon. The arrangement is such that the amount of paper left has sufficient strength to avoid tearing at this location taking into consideration the tensions being maintained on the web for production.

Figure 19:
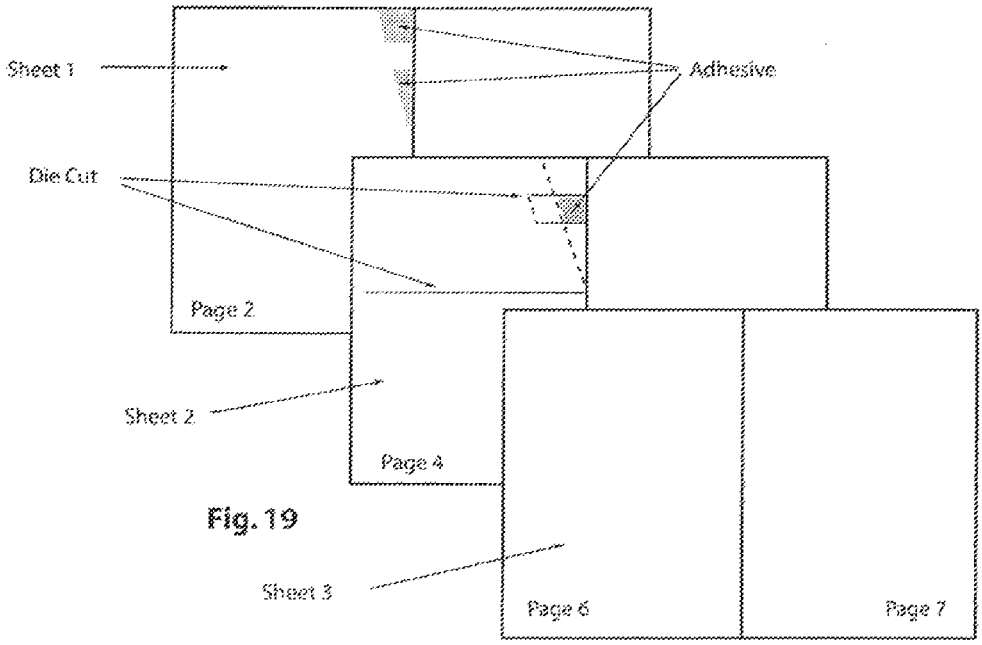
FIG. 19 is a view similar to FIG. 5 showing the product of FIGS. 18A and 18B.

Immediately after the die-cutting, the three ribbon webs pass through an adhesive application station, and an adhesive pattern is deposited on page 2 of the left hand ribbon at a location near the center line thereof. Simultaneously, an adhesive pattern is placed on the surface of page 4 on the tab of the hinge arm, that also lies adjacent the center line of this panel which comprises pages 4 and 9. The three ribbon webs are then aligned; the middle ribbon web (labeled Sheet 2 in FIG. 18B), which carries the series of pages 4 and 9, is sandwiched between the other two ribbon webs. Upon such sandwiching, the adhesive patterns secure portions of the integrally created 3D piece to surfaces of facing pages 2 and 5. The individual layout of the pages and the placement of the adhesive patterns are more clearly seen in FIG. 19. Final trimming, folding and severing is as earlier described.

Very generally overall, the specialty die-cutting operation, termed Kiss Cutting provides the ability to run one or more thicknesses of paper but only die-cut the thickness of the top sheet rather than all thicknesses. Kiss-cutting a top sheet supported by one or more sheets enables faster and better quality production and product. Adjacent connected pages within the signature are of course printed and positioned for correct pagination. Standard adhesive applicators are used for the application of adhesive to a page within the signature being printed and formed. As one of a number of options, the left upper half of the center sheet in the 3-sheet stack has a printed 3D piece die-cut therein with an adhesive pattern applied at about the same time or immediately thereafter. It is unique that the 3D piece is formed from one page, e.g. page 3/4, that remains integrally connected to page 9/10 along the fold line. The alternative of printing dormant adhesive in the conventional print area would make it possible to facilitate open non-tack areas as needed. Another press, at the same time might be producing additional pages, that collectively would become part of the same signature. Coadhesive could likewise alternatively be used.

FIGS. 12-14 show that it is possible to create multiple 3D pieces from the same page which are hinged at different angles. It is also possible, with additional pages, to have more 3D pieces singularly and in multiples and in varying directions and positions, head, foot or middle, anywhere from edge to edge, vertically and horizontally, with one signature.

Adhesives are very important relative to what, where and when used. Their selection varies depending on the design of the press and product design/format and what press layouts/designs are being used. For instance, there will be some printers that will have large presses with enough print stations to satisfy printing the adhesive, like ink, while the product signature is being printed, versus having a separate bonding material applied using mobile applications after there has been ink printing. Moreover, when paper is being formed, such as folding, such may be facilitated by the use of dormant adhesive which is subsequently bonded by activating it.

The adhesive material can be pressure-sensitive, or immediate initial base 1 application or attachment bonding for subsequent tack activation bonding base 2. When pressure sensitive adhesive is used, it is important to avoid rollers etc. until there is adhesive contact with the substrate to which it is to bond. Coadhesives may also be used.

For latitude of design, and versatility in options for location placement, various adhesives come into use. Adhesive may be used that will bond to paper but present a free surface that will only bond to a cohesive. With the uniqueness and the possibility of multiple products of design presented here, cohesive (adhesive that only bonds to other cohesive patterns) is a positive feature. It can be applied in both positions together or one at a time; no bonding occurs until contact is made. Such use enables versatility as to the best location to bond together two or more paper surfaces in a fast-moving web or ribbon webs, i.e. allows movement, such as feeding under guides, without concern of offsetting or bonding, which only occurs when one cohesive pattern contacts the intended cohesive pattern. With quick-setting adhesives, there is also a distinct advantage in situations that print at very high speed. Adhesive can be formulated that assumes tack by variable means, electric, sound, light, etc., as quickly as it goes dormant. This enables processing without fear of bonding to other paper or press parts, as a web is conveyed; binding occurs until adhesive is activated for bonding. This can be a distinct advantage for 3D format printing. Heat, sound, vibration, light and various electrostatic activation means can eliminate the present day printing industry sequences of: apply the adhesive, make contact, allow to dry, and check bonding before use.

Figure 20A:
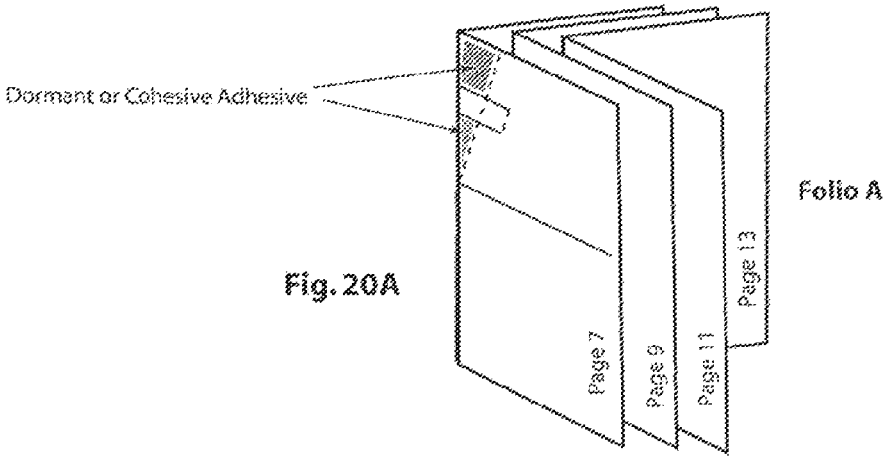
FIG. 20A is a view similar to FIG. 7 of the product shown in FIG. 19.

The use of either dormant adhesive or coadhesive can be used to facilitate the creation of a 3D piece at the interface between two signatures. FIG. 20A shows a 12-page signature in exploded perspective where the 3D piece has been die-cut to now form an element of page 7/8. In this signature, which is marked Folio A, it should be understood that there would be an adhesive bond between the tab at the end of the hinge arm on page 8 and the facing section of page 9. The base of the 3D piece is shown with its generally triangular surface covered with either a dormant adhesive or a co-adhesive. Either would permit handling of the signature without difficulty throughout the printing and collating steps because such adhesive pattern would exhibit no tack.

Figure 20B:
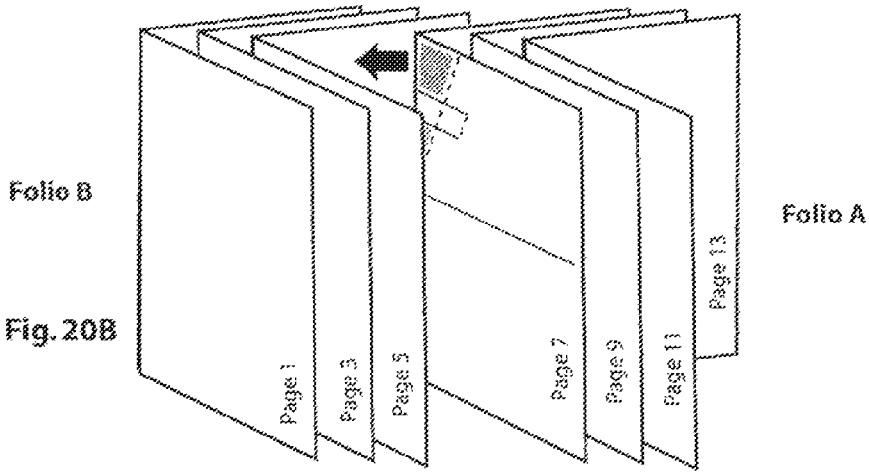
FIG. 20B shows a mating of the signature of FIG. 20A with another signature.

FIG. 20B shows the step of mating of two such signatures of appropriate pagination. Although it is illustrated as though partially folded folios are being assembled, e.g. for saddle-stitching type binding, it should be understood that the two Folios A and B could be simply superimposed in their flat form and then folded as described hereinafter. To effect the bonding of the triangular base of page 7 to the juxtaposed surface of page 6 of Folio B, the dormant adhesive would be activated via the application of heat, light, vibration, ultrasound, or gaseous or liquid reactant. Alternatively, if the triangular base were coated with coadhesive, then a complementary coadhesive pattern would be applied to page 6 of Folio B so that the matching two patterns would bond these sections of pages 6 and 7 together.

Figure 20C:
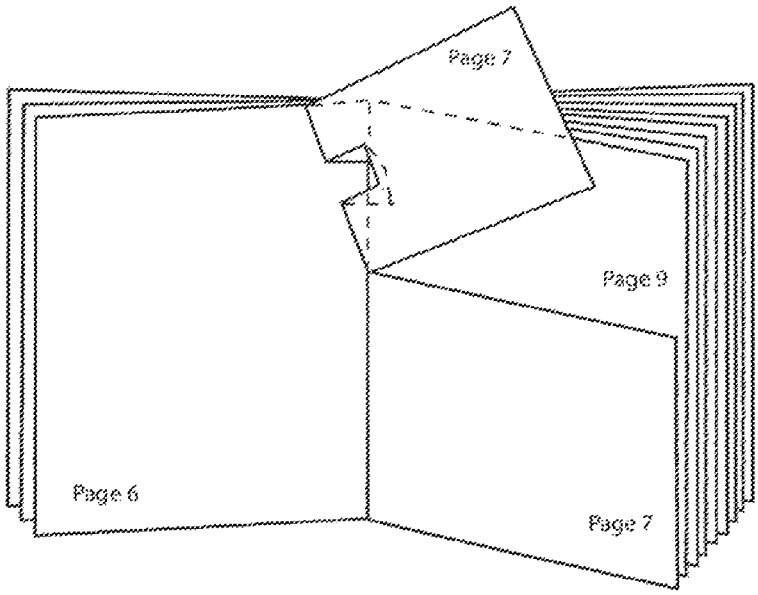
FIG. 20C is a perspective view open to pages 6 and 7 showing the product which results from FIG. 20B.

FIG. 20C shows the final 24 page booklet or the like opened to pages 6 and 7. In this arrangement, while page 7/8 remains connected to page 17/18 along the fold line therebetween at the spine, the 3D piece stands up in attention-attracting orientation, between pages 6 and 9. It is situated in the booklet with pages 1-6 preceding it and with pages 9-24 following it.

An alternative type of construction is shown in FIGS. 21A-21E. In this arrangement, two 12-page folios are shown being printed in flat form. In FIG. 21A, one folio is shown with a dormant adhesive pattern printed onto page 6 in a generally triangular region to attach to the base of a 3D piece. In companion FIG. 21B, the second folio is shown with the 3D piece kiss-cut from page 7/8. For purposes of illustration only, FIG. 21C shows the opposite surface of the panel which constitutes pages 7/8 and 17/18 where an adhesive pattern is applied to the tab region at the end of the hinge arm of the die-cut 3D piece. It may also be a dormant adhesive pattern, or it may be any regular quick-setting adhesive. The two flat 12-page signatures from FIGS. 21A and 21B are then superimposed, and the dormant adhesive is appropriately activated. Such causes bonding to occur between the surfaces of pages 6 and 7 (and also between the surfaces of pages 8 and 9 if dormant adhesive was also used for that pattern). The mating of the two folios is shown in FIG. 21D (in partially folded form simply for illustrative purposes), and FIG. 21E shows the resultant product, which is essentially the same as that shown and described with respect to FIG. 20C.

Figure 22A:
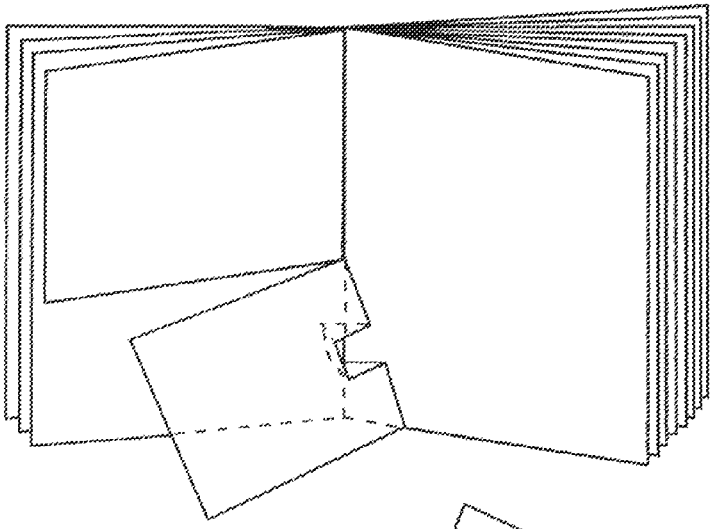
FIGS. 22A, 22B, and 22C show alternative embodiments of signatures embodying various features of the invention.
Figure 22B:
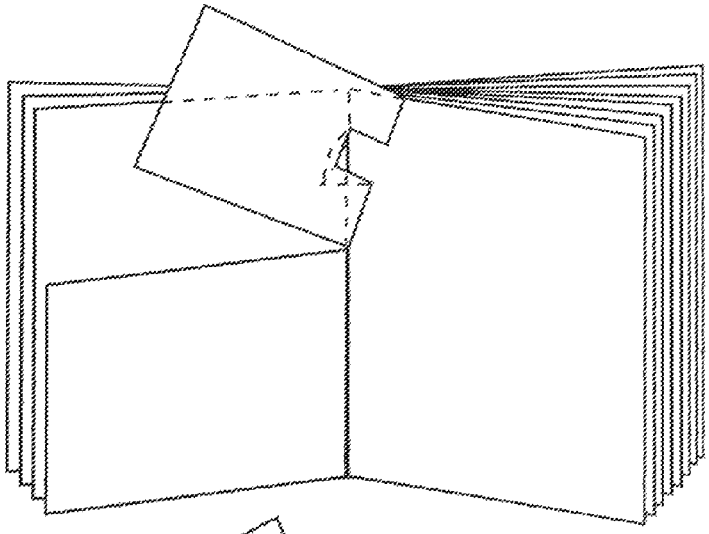
Figure 22C:
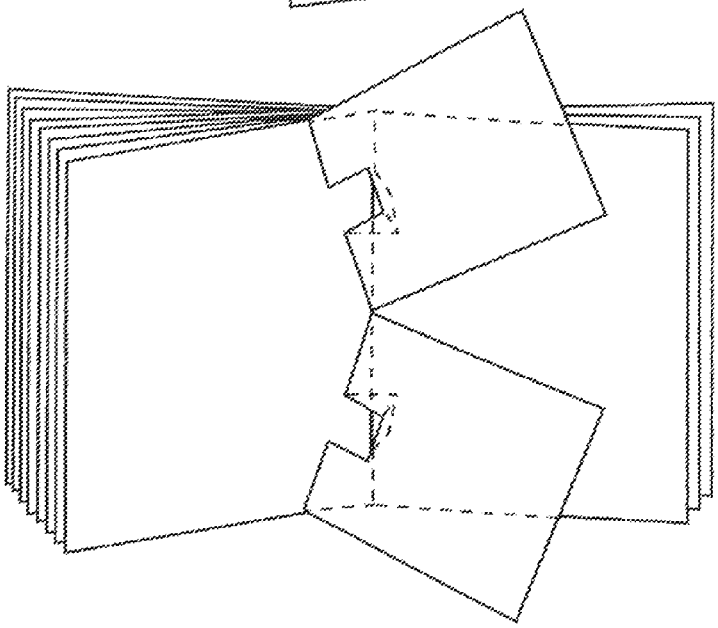

The versatility of the production method is illustrated in FIGS. 22A, 22B and 22C. FIG. 22A shows that the 3D piece can be die-cut from a bottom portion of a page, i.e. page 7/8, and a hinge arm may be adhesively attached to page 6 with the triangular base being adhesively attached to page 9 so that it opens in the opposite manner. FIG. 22B likewise shows a 3D piece die-cut from the upper half of the page with the hinge arm affixed to page 6 as just described. FIG. 22C shows that the pop-up 3D pieces can be likewise located near the rear of the finished product. In the 24-page booklet of FIG. 22C, two 3D pieces are shown as having been die-cut from pages 17/18 with their triangularly shaped bases adhesively attached to page 16, and their hinge arm tabs being adhesively attached to page 19.

During present times many desired changes for improvement strive to be accomplished. In the publication and printing businesses, this is the case as printing continues to go forth with means of economy and new formats. The following embodiment is a rendering of significant product that has now become available to replace 35 years of prior, and still present, paper formats.

Web Press is the name that has become very common as it has replaced sheet fed printing presses with rolls of paper stock in various weights and thickness. There are fewer sheets of paper than rolls when it comes to volume printing. Web Presses initially printed and delivered product in sheets and or rolls to be finished to meet the desired uses.

There are many different uses that require a second or third operation beyond what the web presses can perform. One noted is the insertion of additional inserts that are put into magazines. These inserts are often fed into varying preprinted signatures prior to the signatures being bound into the final item, usually magazines. The signatures are gathered as they are being fed into the binders, saddle stitching or perfect binding for completion. In order to be bound, attachment means are added to the insert to attach them to the signatures that have been preprinted.

What follows is a unique means that enables blank paper to be printed, die cut, have adhesive applied and/or have dormant adhesive activated, folded and/or pages aligned and then delivered finished for further use or application.

Figures 23, 24, 25, 27:
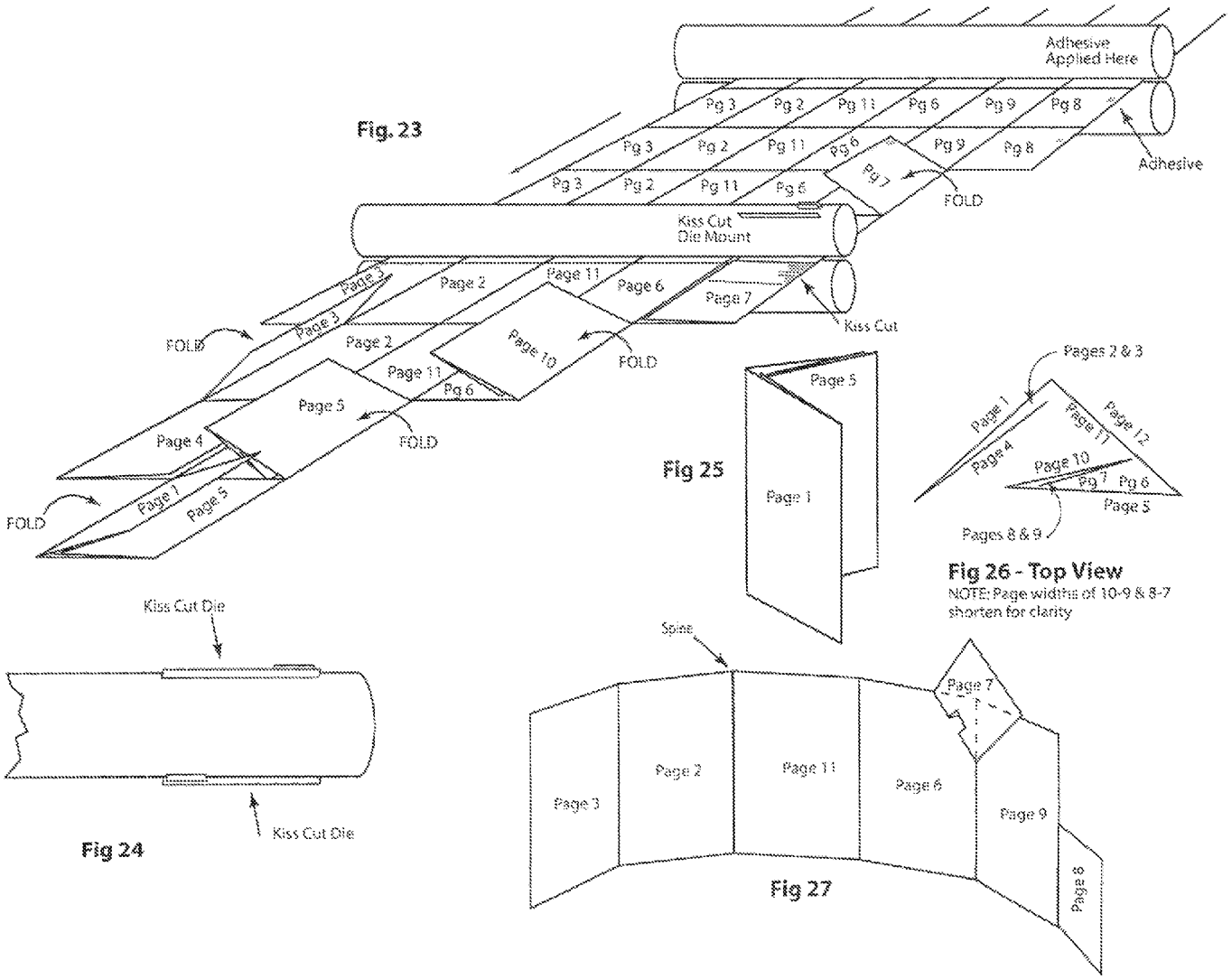

FIG. 23 is a detailed schematic diagram of a web press printing and finishing operation showing the production of a 12 page signature with one 3D piece die cut to be an intrinsic part of pages 7 and 8. The completed product has many uses of value and has originated from a roll of blank paper.

Shown are adhesive applications upon pages 7 and 8, folding, kiss cutting of the intrinsic 3D piece, and further folding. The kiss-cutting of the 3D piece may be as described with respect to FIG. 28B which follows. It may be left attached with short frangible bonds that readily break upon opening or unfolding. The ultimate center fold is between pages 1&2 and 11&12. Pages 3 & 4 fold against Pages 1&2. Pages 7&8 fold against Pages 9&10, which 4 pages fold against Pages 5&6. Pages 5&6, 7&8 along with 9&10 fold collectively against Pages 11&12. There are 4 pages to the left of the center fold, and 6 pages to right of center fold allowing large unfolding with the 3D piece between pages 6 and 9.

FIGS. 25, 26 and 27 show the specific positioning of the pages and the folding, using the page numbers in FIG. 23. The rotary kiss cutting die device is shown in FIG. 24.

Figure 28A:
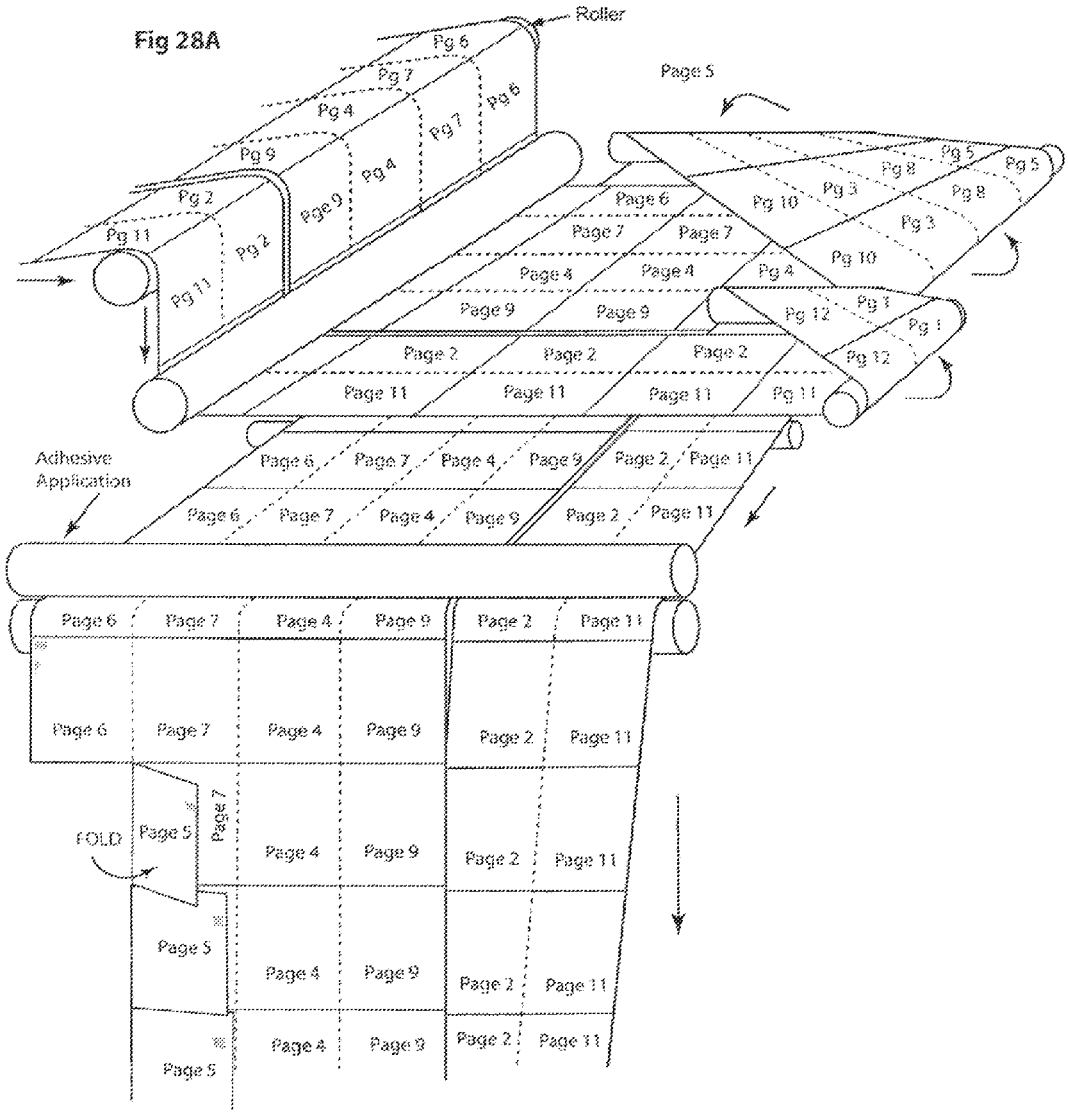
FIG. 28A shows a perspective view of one more web press operation embodying various features of the present invention.

FIG. 28A shows another web press setup with right angle folding. Shown are the combination of the folding of one web section, comprising pages 5&6, 7&8, 3&4 and 9&10 and the slit web section comprising 1&2 and 11&12. Adhesive is applied simultaneously to pages 5 and 6 just before they are folded, and the web sections are aligned with pages 4 and 9 above pages 2 and 11.

FIG. 28B shows the completion of the aligning and kiss-cutting of the folded page 5/6 to create the 3D piece, followed by the final folding. The kiss-cut die cuts the vertical edge of the 3D piece near the fold line between pages 5/6 and 7/8 together with the lateral cuts shown. As mentioned before, short frangible bonds can be allowed to remain. In FIG. 29, pages 5/6 and 7/8 are shown in the foreground hinged to page 3/4, with pages 1/2 and 11/12 in the background. There are more pages to the left of center fold, which lies between pages 4 and 9, than to the right of center fold. FIG. 30 shows the final product, where the reader is attracted to the folded pages. It allows center spreads of more than just 2 pages, e.g. a four-page spread plus a dimensional; when fold-out pages 5/6 and 7/8 are unfolded, the 3D piece stands out prominently.

Beginning from a blank roll of paper, a finished 3 Dimensional Design Product is developed. More than one 3D piece can be included to draw additional attention. The product saves money relative to what is current today.

It should be understood that there are a number of key elements that play a part in the handling and the speed of movement to allow a properly designed single sheet 3D piece to be kiss-cut and adhesively attached as a part of such a signature composite. These include the following items: the weight of the sheet material, e.g. paper, the direction of the grain of the paper, the extent of the die-cutting to which the paper is subjected, the positions of the individual die-cuts, the amount and type of adhesive to be applied, the positioning of the adhesive, and the overall compatibility of the adhesive positions with the capability of the feeding equipment that will be used to bond the pop-up item as part of a mass production fabrication of magazines. However, all are capable of adoption to the operations described hereinbefore.

Although the invention has been described with regard to a number of presently preferred embodiments, which illustrate the best mode known to the inventor for carrying out the invention, it should be understood that various changes and modifications as would be obvious to those having ordinary skill in this art may be made without departing from the scope of the invention which is defined in the claims appended hereto. For example, the various types of adhesive and other bonding applications shown in any of these different embodiments are generally considered to be equally applicable to other of the illustrated embodiments, and other types of co-adhesive and thermally or UV-activated adhesives can be employed. Generally, such adhesive can be applied to the opposite or facing pages from that illustrated, or to both pages. Also, the lines of weakness may be achieved during die-cutting or kiss-cutting or might be omitted because of paper thinness.

The invention claimed is:

1. A method of making magazines that includes a pop-up structure on a web press wherein a 3D pop-up piece is operatively created as a part of one printed page of the web, which method comprises:

printing a plurality of first signatures on the web of a web fed press, which first signatures each include at least three pairs of pages which are designed for assembly in juxtaposition with one another to create a portion of a magazine and which at least three pairs include a front page, a central page and a rear page, conveying said pages along a path as a part of the assembly of a first signature, placing adhesive on a surface of said web at a location which will create an adhesive bond between said central page and either said front or rear page of said signature, kiss-cutting a flat 3D piece from said central page while it is in surface to surface contact with one of said front and rear pages with said adhesive sandwiched therebetween, placing adhesive on another surface of said web at a location where it will create a bond between the opposite surface of said central page in the region of said 3D piece and said facing surface of the other of said front and rear pages, juxtapositioning the other page in association with said central page as a part of said first signature, and completing the assembly of said magazine by collecting said first signature and associating it with other signatures for binding, whereby said kiss-cut 3D piece becomes adhesively attached between the facing front and rear pages and when a recipient of the magazine opens same to said kiss-cut central page, said 3D piece pops-up and assumes an attention-attracting three-dimensional configuration in direct association with said facing front page.

2. The method of claim 1 wherein said at least three pairs of pages are part of an integral web when printed.

3. The method of claim 2 wherein one of said at least three pairs of pages is folded about a hinge line in said integral web onto another pair during one folding operation.

4. The method of claim 3 wherein adhesive is applied to one of said pages of said at least three pairs of pages before said one folding operation.

5. The method of claim 4 wherein said kiss-cutting is carried out subsequent to said one folding operation.

6. The method of claim 4 wherein said pair of pages that is being folded as a part of said one folding operation is folded upon itself prior to completing said one folding operation.

7. The method of claim 1 wherein said flat 3D piece is located at the upper edge of said one page so it remains attached to the page in the web longitudinally above it until each said signature is severed from said web.

8. The method of claim 7 wherein said flat 3D piece is cut to provide a cut line which extends from a centerline between the two pages of the pair being cut and which terminates just short of the lateral edge of said one page, and wherein said 3D piece is freed from the remainder of said one page by trimming the lateral edges of said completed signature.

9. A method of making magazines which include a pop-up structure wherein a 3D piece is operatively created as a part of one printed page, which method comprises:

printing a plurality of signatures on a web fed press, which signatures each include a group of at least three sheets which carry side-by-side pairs of printed pages that are designed for juxtaposed assembly to create a portion of a magazine, said group including a front sheet, a central sheet and a rear sheet, conveying said sheets along a path as a part of the assembly of a first signature and applying adhesive to at least one page of one of said sheets, superimposing said central sheet and one of said front and rear sheets with said adhesive sandwiched therebetween, kiss-cutting a flat 3D piece from said central sheet while it is in surface to surface contact with said one of said front and rear sheets, placing adhesive on another surface of said web at a location where it will create a bond between the opposite surface of said central sheet page and said facing page of the other of said front and rear sheets in the region where said kiss-cut 3D piece is located, associating said other sheet in surface contact with said central sheet as a part of completing said first signature, and completing the assembly of said magazine by collecting said first signature and associating it with other signatures for binding, whereby said kiss-cut 3D piece becomes adhesively attached between two facing pages and when a recipient of the magazine opens same to the kiss-cut page of said central sheet, said 3D piece pops-up and assumes an attention-attracting three-dimensional configuration in direct association with said facing pages.

10. The method of claim 9, wherein said at least three sheets are part of an integral web when printed.

11. The method of claim 10 wherein one of said side-by-side pairs of pages is folded about a hinge line in said integral web onto another said pair as part of one folding operation.

12. The method of claim 11 wherein adhesive is applied to one of said pages of said one pair or said another pair before said one folding operation.

13. The method of claim 12 wherein said kiss-cutting is carried out prior to said one folding operation.

14. The method of claim 11 wherein said one pair of pages that is being folded is earlier folded upon itself prior to said one folding operation.

15. The method of claim 9 wherein said flat 3D piece is located at the upper edge of one page of said central sheet so it remains attached to the page in the web longitudinally above it until each said first signature is severed from said web.

16. The method of claim 15 wherein said flat 3D piece is cut to provide a cut line which extends from a centerline between the two pages of the central sheet and which terminates just short of the lateral edge of said one page, and wherein said 3D piece is freed from the remainder of said one page by trimming the lateral edges of said completed signature.

17. A method of making magazines on a web press, which magazines include a 3D pop-up piece that is operatively created as a part of one printed page, which method comprises:

printing a plurality of first signatures on a web of a web fed press, which first signatures each include at least three sheets that respectively contain pairs of numbered or designated pages that are designed for juxtaposed assembly to create at least a part of the first magazine signature and that include a front page, a central page and a rear page as printed parts of said three sheets, conveying said pages along a path as a part of the assembly of the first signature, placing first adhesive on a surface of said web at a location which will create an adhesive bond between said central page and one of said front and rear pages of the signature, cutting a flat 3D piece from a region of said web that comprises said central page, placing second adhesive on another surface of said web at a location where it will create a bond between the opposite surface of said central page in the region of said 3D piece and said facing surface of the other of said front and rear pages, severing said web to detach said three sheets from one another, manipulating said severed web to place said central page in contact with said one of said front and rear pages with said first adhesive sandwiched between it and one surface of said central page, placing said other page in contact with the opposite surface of said central page and completing the first signature, and completing the assembly of said magazine by collecting the first signature and associating it with a plurality of other signatures for binding, whereby said 3D piece becomes adhesively attached between facing front and rear pages in the first signature so that when a recipient of the magazine opens same to said central page, said 3D piece pops-up and assumes an attention-attracting three-dimensional configuration in direct association with said facing front page.

18. The method of claim 17 wherein said front, central and rear pages are part of an integral web when printed.

19. The method of claim 17 wherein adhesive is applied to two of said front, central and rear pages at the same time and wherein following juxtaposition with one another all of said at least three pairs of pages are folded about the same hinge line.

* * * * *